US007320326B2

(12) United States Patent
Intorp et al.

(10) Patent No.: US 7,320,326 B2
(45) Date of Patent: Jan. 22, 2008

(54) METHOD FOR THE TREATMENT OF TOBACCO

(75) Inventors: Michael Intorp, Halstenbek (DE); Hans-Jürgen Nikulla, Jork (DE)

(73) Assignee: Reemtsma Cigarettenfabriken GmbH (DE)

( * ) Notice: Subject to any disclaimer, the term of this patent is extended or adjusted under 35 U.S.C. 154(b) by 216 days.

(21) Appl. No.: 10/466,843

(22) PCT Filed: Jun. 15, 2001

(86) PCT No.: PCT/EP01/06776

§ 371 (c)(1),
(2), (4) Date: Jul. 21, 2003

(87) PCT Pub. No.: WO02/058490

PCT Pub. Date: Aug. 1, 2002

(65) Prior Publication Data

US 2004/0050398 A1 Mar. 18, 2004

(30) Foreign Application Priority Data

Jan. 24, 2001 (DE) ..... 101 03 123

(51) Int. Cl.
*A24B 3/12* (2006.01)

(52) U.S. Cl. ..... 131/300; 131/290

(58) Field of Classification Search ..... 131/309, 131/290, 299, 300

See application file for complete search history.

(56) References Cited

U.S. PATENT DOCUMENTS

| | | | | |
|---|---|---|---|---|
| 3,402,479 A | | 9/1968 | Hohm et al. | |
| 3,828,798 A | * | 8/1974 | Harper et al. | 131/311 |
| 4,004,594 A | | 1/1977 | Wochnowski et al. | |
| 4,186,755 A | * | 2/1980 | Schmidt | 131/303 |
| 5,161,548 A | * | 11/1992 | Neville | 131/296 |
| 5,299,583 A | * | 4/1994 | Lasch et al. | 131/312 |
| 5,755,238 A | * | 5/1998 | Soots et al. | 131/302 |
| 5,813,413 A | * | 9/1998 | Metzner et al. | 131/109.1 |
| 6,718,988 B1 | * | 4/2004 | Cooper et al. | 131/300 |

FOREIGN PATENT DOCUMENTS

| | | |
|---|---|---|
| DE | 3119330 A1 | 2/1982 |
| DE | 4142631 | 6/1993 |
| GB | 508264 | 8/1938 |
| WO | WO9003124 | 4/1990 |
| WO | WO9923898 | 5/1999 |

OTHER PUBLICATIONS

Voges, Erns, *Tobacco Encyclopedia*, Mainzer Verlagsanstalt und Druckerel Will und Rothe GmbH & Co. KG (Publisher), pp. 418 and 419, ISBN 3-920615-07-7 (1984).

* cited by examiner

*Primary Examiner*—Steven P. Griffin
*Assistant Examiner*—Dennis R. Cordray
(74) *Attorney, Agent, or Firm*—Hovey Williams LLP

(57) ABSTRACT

In a process for the treatment of tobacco, in particular Burley tobacco, the tobacco, which is preferably in the form of leaf tobacco, is treated with a casing, which preferably contains sugar. A thermal treatment of the casing-treated tobacco with saturated steam follows, wherein, before the steam treatment, the tobacco moisture content is in the range from 15% to 25% and wherein, after the steam treatment, the tobacco moisture content is in the range from 15% to 25% and the tobacco temperature is in the range from 80° C. to 115° C.

24 Claims, No Drawings

METHOD FOR THE TREATMENT OF TOBACCO

This application is a 371 of PCT/EP01/06776, filed Jun. 15, 2001 and claims the benefit of GERMAN Application No. 10103123.8, filed Jan. 24, 2001.

BACKGROUND OF INVENTION

1. Field of the Invention

The invention relates to a process for the treatment of tobacco, in particular Burley tobacco, by the application of casing and subsequent thermal treatment.

2. Discussion of Prior Art

The application of so-called casing is a customary procedure in the preparation of leaf tobacco before cutting. The aim of a casing treatment is the improvement of the processability as well as the taste properties of the tobacco material. Normal constituents of casings are humectants such as e.g. glycols or glycerol, sugar and solid natural substances such as for example cocoa or licorice. High viscosity and the solids content of casings make a desired, even penetration of the tobacco product by the casing components more difficult. In order to improve the penetration of the casing into the cell structure of the tobacco, the application of the heated casing is carried out together with a moistening by water and steam in units called casing drums. The conventional technique of casing application is described in Voges, "Tobacco Encyclopedia", Mainzer Verlagsanstalt und Druckerei Willi und Rothe GmbH & Co K G, Mainz, 1984; p. 65 (Keyword "Casing"), p. 411 (Section on "Tobacco Flavours and Casings"), pp. 416 and 417 (Section on "The Production of Cut Tobacco", passages headed "Special Treatment for Burley" and "Casing").

As a rule, Burley tobaccos combine relatively high levels of nitrogen compounds and low sugar contents. For this reason, an acceptable smoke taste can often be achieved only by using sugar-containing casings in combination with a subsequent thermal treatment. Along with a removal of volatile nitrogen compounds by the thermal treatment, reaction products such as e.g. pyrazines can form from sugar and nitrogen components which contribute to the improvement of the sensory quality. As a rule, a so-called belt dryer with several drying and cooling zones is used for the thermal treatment of casing-treated Burley tobacco, the tobacco being dried from approx. 30% initial moisture content to approx. 5% moisture content. For further processing, in particular for cutting, the tobacco has to be moistened again to approx. 16% to 22%.

This conventional procedure has several disadvantages. Firstly, in the case of application through a casing drum, the penetration of the casing into the leaf material is not optimal, due to the low action intensity of the steam. Furthermore, much energy has to be expended for the strong drying. Belt dryers also occupy a lot of space and, because of their design, lead to an inhomogenous moisture distribution. A further disadvantage is the high level of fragility of the tobacco material at moisture levels under 10%, which leads to losses through formation of tobacco fines and dust.

For this reason several processes have been described which are said to circumvent one or more disadvantages of the conventional treatment method.

U.S. Pat. No. 5,755,238 describes a method for quick drying, cooling and remoistening using a drying unit divided into several treatment zones and remoistening in a separate steam tunnel. The moisture content of the tobacco material is approx. 30% before drying, approx. 5% before the steam tunnel and approx. 15% after the remoistening. The hot air temperature of the dryer is approx. 105° C. to 115° C. and the total passage time approx. 60 seconds. By using several fluidized-bed drier zones an improved moisture homogeneity is said to be achieved.

U.S. Pat. No. 4,004,594 discloses a method for conditioning tobacco, in particular Burley tobacco, which provides for an impregnation of the tobacco particles with casing, a thermal treatment to expel the nitrogen or the nitrogen compounds and the adjustment of the desired moisture content. The treatment plant consists of a dosing unit, a casing drum, a preconditioning unit for the treatment with steam and units for the heating, cooling and remoistening of the tobacco. The tobacco moisture contents are 14% to 20%, preferably 18%, after the dosing unit, 30% to 42%, preferably 32%, after the casing drum, approx. 35% after preconditioning, 4% to 7% after heating and approx. 18% to 22% after remoistening. In the preconditioning unit a treatment with saturated steam of 2.5 bar to 3.5 bar takes place, resulting in a tobacco temperature of approx. 70° C., in order to achieve an improved penetration of the casing into the tobacco leaf.

U.S. Pat. No. 3,402,479 describes a tunnel-like apparatus for transporting and treating nitrogen-rich tobacco with zones for predrying, for heating the tobacco without loss of moisture by using a correspondingly conditioned medium and for cooling the treatment product. The moisture content of the tobacco material upon entry is 40% to 50%, the temperature of the medium after the predrying approx. 100° C. and the moisture on leaving approx. 16% to 18%. The use of this process, costly in terms of apparatus, in combination with the extremely high moisture contents upon entry is intended to avoid an overdrying of the tobacco material and the associated increase in fragility.

OBJECTS AND SUMMARY OF THE INVENTION

It is the object of the invention to create a process for the treatment of tobacco, in particular Burley tobacco, by application of casing and subsequent thermal treatment, which avoids the disadvantages of the described processes. In particular, the number of necessary process steps is to be reduced and the energy requirement lowered, and a uniform product quality achieved.

This object is achieved by the process for the treatment of tobacco with the features of claim 1. Advantageous versions of the invention result from the dependent claims.

DETAILED DESCRIPTION OF THE PREFERRED EMBODIMENT

In the process according to the invention the tobacco with applied casing and containing approx. 15% to 25% moisture, which as a rule is in the form of leaf tobacco, is subjected to an intensive steam treatment. Immediately after the steam treatment, the tobacco temperature is in a range from 80° C. to 115° C., while the tobacco moisture content is 15% to 25%. An intermediate step, which leads to a strong drying of the tobacco, does not occur in the process according to the invention.

The steam treatment is preferably carried out such that the tobacco is brought into intensive contact with the treatment medium for a period of 0.1 minutes to 10 minutes.

The ratio of mass flow rate of steam to tobacco (each in kg/h) is preferably set in a range from 0.1 to 0.5.

The treatment is preferably carried out in a so-called steam tunnel. Such units can be obtained for example from Sagemüller GmbH, Bockhorn or HAUNI Maschinenbau AG, Hamburg. When using a steam tunnel, saturated steam with a pressure (before being fed into the steam tunnel) of 2 bar to 12 bar is preferably used, particularly preferably from 4 bar to 10 bar.

Surprisingly it has been shown that, with the process according to the invention, in addition to an improved casing penetration, through the preferred use of the steam tunnel, the desired effects of the thermal treatment, i.e. the expulsion of volatile nitrogen compounds and a reaction of sugars and nitrogen components, can also be achieved in a single process step.

With the process according to the invention, the moisture of the tobacco changes during the steam treatment by some percent only, depending on the choice of process parameters such as steam pressure and residence time (time of exposure to the steam). By selecting a suitable moisture upon entry, the moisture required for cutting can thus be achieved directly.

Due to the small moisture gradient in the process, the tobacco treated according to the process of the invention has a clearly more homogenous moisture distribution than that which was treated with a belt dryer according to the conventional process.

According to the state of the art, medium-volatility aromas in the form of a so-called topdressing, which is preferably alcoholic, can be applied to the tobacco treated according to the invention after steam treatment and cooling.

Afterwards, the tobacco is fed to the cutting process, alone or after being mixed with other types of tobacco, without further moistening or drying steps.

Further details of the implementation and effects of the process according to the invention can be obtained from the following embodiments. It can be recognised, in particular, that reductions in total amino acids and ammonia corresponding to the conventional process can be ascertained, which can be seen as characteristic of the desired effects of the thermal treatment. This is confirmed by the results of the sensory smoke assessment.

Furthermore, it can be seen from the embodiments that the effects of the secondary treatment can be changed by changing the time of exposure to the steam or also correspondingly a raising of the treatment temperature or the pressure of the steam, without influencing to a greater extent the moisture content on leaving (i.e. the tobacco moisture after the steam treatment). In particular, an adaptation to the nitrogen content of the tobacco material can take place in this way, in order to expel smaller amounts of volatile nitrogen compounds, for example, in the case of nitrogen-poor tobacco than with nitrogen-rich tobaccos, which in turn can lead to improved sensory results.

The advantages of the process according to the invention vis-à-vis the known processes lie in the more economical implementation resulting from the lower expenditure on apparatus and energy requirement. As an overdrying is dispensed with, losses of tobacco are minimised. An improved moisture homogeneity of the end product is achieved vis-à-vis the conventional process. This leads, in combination with the good casing penetration, to a clear reduction in the formation of spots on the paper of cigarettes produced with the tobacco treated according to the invention.

EXAMPLE 1

Conventional Process

A high-quality-grade Korean Burley with a nicotine content of 3.1% and an inexpensive Italian Burley as so-called filler with a nicotine content of 1.5%, each relative to dry matter, served as base material for the test. A partly inverted aqueous sucrose solution was applied to both tobaccos, in the same amount and quality, which were thermally treated according to two methods (Example 1, Example 2), in corresponding pilot plants. The total sugar content before the thermal treatment was 10%.

The so-called fluidized-bed drier (Example 1) represents the application of a conventional process and is based on the principle of the vibrating conveyor with bores in the base plate, over which hot air flows through the treatment product. The initial moisture (moisture upon entry) of the leaf tobacco was a uniform 22%.

The drying of the tobacco samples in unsealed aluminium pots using a calibrated circulating-air drying cabinet at a temperature of 80° C. during a period of 3 hours served, as in all the following examples, to determine the tobacco moisture.

Table 1 shows the hot air temperatures used, the corresponding residence times and the moisture contents upon leaving (i.e. tobacco moisture contents after treatment in the fluidized-bed drier) of the leaf tobacco.

TABLE 1

Parameter combinations for fluidized-bed drier

| No. | Hot air temperature (° C.) | Residence time (sec) | Moisture content upon entry (%) | Moisture content on leaving (%) |
|---|---|---|---|---|
| 1 | 130 | 15 | 22 | 6 |
| 2 | 150 | 30 | 22 | 3 |
| 3 | 200 | 40 | 22 | ≦1 |

EXAMPLE 2

Process According to the Invention

The same basic tobaccos with applied partly inverted sucrose were used as in Example 1. The initial moisture content was a uniform 18% here.

A conventional steam tunnel with a vibrating conveyor, in which hot steam (saturated steam) flowing out of bores in a base plate interacts with the leaf tobacco, served as treatment unit; in principle, atmospheric pressure (open system) prevails in the steam tunnel. The pressure of the steam before being fed into the steam tunnel was uniformly approx. 7 bar and the mass ratio of tobacco to steam 0.2. Table 2 shows the parameter combinations used. The tobacco temperature upon discharge and the moisture content on leaving are the tobacco temperature and the tobacco moisture content, respectively, directly after the steam treatment.

TABLE 2

Parameter combinations for steam tunnel

| No. | Tobacco temperature upon discharge (° C.) | Residence time (min) | Moisture content upon entry (%) | Moisture content on leaving (%) |
|---|---|---|---|---|
| 4 | 106 | 3 | 18 | 18 |
| 5 | 108 | 6 | 18 | 17 |
| 6 | 112 | 9 | 18 | 15 |

It will be seen that the tobacco in the steam tunnel relatively quickly reached a stationary state in which tobacco temperature and tobacco moisture content changed only slightly during the course of the steam treatment.

COMPARISON

The two tables 3 and 4 compare for each of the two basic tobaccos examined the results achieved according to the respective parameter combinations 1 to 3 or 4 to 6 described in Tables 1 and 2. The levels of total amino acids and ammonia were examined, each relative to dry matter (DM).

TABLE 3

Analysis data for treated Korean Burley

| No. | Total amino acids (mmol/kg DM) | Ammonia (% DM) |
|---|---|---|
| 1 | 488 | 0.56 |
| 2 | 456 | 0.47 |
| 3 | 359 | 0.40 |
| 4 | 424 | 0.56 |
| 5 | 405 | 0.51 |
| 6 | 385 | 0.48 |

TABLE 4

Analysis data for treated Italian Burley

| No. | Total amino acids (mmol/kg DM) | Ammonia (% DM) |
|---|---|---|
| 1 | 549 | 0.82 |
| 2 | 498 | 0.68 |
| 3 | 420 | 0.55 |
| 4 | 502 | 0.77 |
| 5 | 478 | 0.68 |
| 6 | 423 | 0.59 |

The comparison of the level of total amino acids and ammonia shows the equivalence of the process according to the invention with a conventional process.

In addition to the analytical examination, the treated Burley tobaccos were cut to prepare test cigarettes and compared with each other in pairs by a committee of experts. In both cases the comparison between the process according to the invention and the conventional process showed no significant differences.

The invention claimed is:

1. A process of treating tobacco, wherein the treatment process comprises the steps of:

treating the tobacco with a casing; and thermally treating the casing-treated tobacco with saturated steam, wherein, before the steam treatment, the casing-treated tobacco moisture content is in the range from 15% to 25% and wherein, after the steam treatment, the tobacco moisture content is in the range from 15% to 25% and the tobacco temperature is in the range from 80° C. to 115° C., wherein the tobacco moisture content upon leaving the steam treatment is at or below the tobacco moisture content before the steam treatment.

2. The process according to claim 1, wherein the time of the steam treatment is in the range from 0.1 minutes to 10 minutes.

3. The process according to claim 1, wherein the mass ratio of steam to treated tobacco is 0.1 to 0.5.

4. The process according to claim 1, wherein the thermal treatment takes place in a steam tunnel.

5. The process according to claim 4, wherein the pressure of the steam before being fed into the steam tunnel is in the range from 2 bar to 12 bar.

6. The process according to claim 5, wherein the pressure of the steam before being fed into the steam tunnel is in the range from 4 bar to 10 bar.

7. The process according to claim 1, wherein, following the steam treatment, the tobacco is treated with a top dressing in a drum.

8. The process according to claim 2, wherein the mass ratio of steam to treated tobacco is 0.1 to 0.5.

9. The process according to claim 2, wherein the thermal treatment takes place in a steam tunnel.

10. The process according to claim 3, wherein the thermal treatment takes place in a steam tunnel.

11. The process according to claim 8, wherein the thermal treatment takes place in a steam tunnel.

12. The process according to claim 2, wherein, following the steam treatment, the tobacco is treated with a top dressing in a drum.

13. The process according to claim 3, wherein, following the steam treatment, the tobacco is treated with a top dressing in a drum.

14. The process according to claim 4, wherein, following the steam treatment, the tobacco is treated with a top dressing in a drum.

15. The process according to claim 5, wherein, following the steam treatment, the tobacco is treated with a top dressing in a drum.

16. The process according to claim 6, wherein, following the steam treatment, the tobacco is treated with a top dressing in a drum.

17. The process according to claim 8, wherein, following the steam treatment, the tobacco is treated with a top dressing in a drum.

18. The process according to claim 9, wherein, following the steam treatment, the tobacco is treated with a top dressing in a drum.

19. The process according to claim 10, wherein, following the steam treatment, the tobacco is treated with a top dressing in a drum.

20. The process according to claim 11, wherein, following the steam treatment, the tobacco is treated with a top dressing in a drum.

21. The process according to claim 1, wherein the tobacco is Burley tobacco.

22. The process according to claim 2, wherein the tobacco is Burley tobacco.

23. The process according to claim 1, wherein the tobacco is leaf tobacco.

24. The process according to claim 2, wherein the tobacco is leaf tobacco.

* * * * *